US006048592A

United States Patent [19]

Rolf

[11] Patent Number: 6,048,592

[45] Date of Patent: Apr. 11, 2000

[54] SYNTHETIC TOP COVERING

[76] Inventor: David E. Rolf, 10512 Montana, Northlake, Ill. 60164

[21] Appl. No.: 08/909,776

[22] Filed: Aug. 12, 1997

[51] Int. Cl.[7] ..... A41G 1/00

[52] U.S. Cl. ..... 428/17; 428/18; 428/19; 428/542.6

[58] Field of Search ..... 428/17, 18, 19, 428/542.6

[56] References Cited

U.S. PATENT DOCUMENTS

| | | | |
|---|---|---|---|
| 284,771 | 9/1883 | Speisser | 428/17 |
| 4,199,627 | 4/1980 | Weder et al. | 428/17 |
| 4,401,700 | 8/1983 | Weder et al. | 428/17 |
| 4,544,585 | 10/1985 | Brenner | 428/17 |
| 4,891,251 | 1/1990 | Fletcher | 428/17 |
| 5,897,926 | 4/1999 | Mikulas | 428/17 |

FOREIGN PATENT DOCUMENTS

2114009 U 10/1972 Germany .

OTHER PUBLICATIONS

Derwent abstract of DE 2114009, Oct, 1972.

*Primary Examiner*—Helene Klemanski

*Attorney, Agent, or Firm*—Lee, Mann, Smith, McWilliams, Sweeney & Ohlson

[57] ABSTRACT

A synthetic top covering replicating a decorative moss used for dressing the top of potted plants and the like. The synthetic decorative moss is composed of a non-woven bundle of individual strands of kinked material which are gathered in a rope-fashion. One end of the bundle is secured to maintain the strands of the bundle together. The strands are colored to replicate moss, and have varying lengths. One or more of the bundles can be formed as a top dressing for a potted plant and the like by draping them in a mat on the plant, with any free ends tucked beneath the mat to hide the gathered ends of the bundles.

19 Claims, 3 Drawing Sheets

SYNTHETIC TOP COVERING

BACKGROUND OF THE INVENTION

This invention relates to decorative coverings for plants and the like, and in particular to a synthetic decorative moss.

Potted plants often have natural or fabricated moss products topping the pot to add an aesthetic look to the potted plant. While the ensuing discussion and description of the present invention will be directed to toppings for potted plants, it will be evident that both the prior art and the present invention can be employed for many uses, and not simply for dressing potted plants.

Problems have occurred with prior art natural and fabricated moss products. Such products decay over time, and can create dust which not only is aesthetically displeasing, but also can affect those suffering from allergies. These products are also susceptible to fading if the plant is in the sun, and because of the brittle nature of the products, they are rather messy both in application and use, requiring constant clean up. Also, in areas where fire hazards are of concern, prior art natural and fabricated moss products, which are highly flammable, cannot or should not be used.

U.S. Pat. No. 5,065,543 is directed to a mat which is placed around a tree or the like to suppress plant growth. It has a series of concentric rings which can be removed as appropriate to fit the size of the tree. Although providing what can be considered to be an aesthetic product around the plant, it is not moss-like.

U.S. Pat. No. 5,425,204 is directed to a plant dressing which consists of a single outer ring and a central open mesh portion. While providing an aesthetic dressing for the plant, it is not moss-like. Similar dressing concepts, although expressed in different forms, are set forth in U.S. Pat. Nos. 2,949,698; 5,171,390 and 5,325,627.

U.S. Pat. No. 5,355,623 is directed to a synthetic protection for the top of a plant, but has no natural look whatsoever. U.S. Pat. No. 2,079,116 is directed to a packing material which can be tucked around a plant, but is directed to a paper-wrapped fibrous material, such as insulation, which is intended to be kept dry and protect the plant while it is being transported or during display.

SUMMARY OF THE INVENTION

The invention is directed to a synthetic decorative material which replicates a natural moss. The synthetic decorative moss is composed of a plurality of individual elongated strands of kinked synthetic material, the strands being gathered in a non-woven bundle in a rope-like fashion. Means proximate one end of the bundle is provided for securing the strands of the bundle together.

In accordance with the preferred form of the invention, the synthetic material forming the strands is a plastic, such as polypropylene, polyester or polyethylene. Each of the strands is generally round in cross section and has a diameter of from about 1/64 inches to about 1/16 inches. The lengths of the strands can vary depending on the desired length of the bundle, and can be from about 4 inches to about 40 feet, or even more.

The bundle comprises about 80 to about 950 of the strands when gathered. Each of the strands is colored, and preferably the coloring comprises a combination of brown, gray, blue and green to replicate natural moss.

In one form of the invention, a mechanical fastener is used for securing the strands of the bundle at one end. The fastener can comprise a hog ring of plastic or metal, a tie of plastic or metal, or a simple string or the like. In another form of the invention, the end of the bundle which is to be gathered together can be fused together, such as by heating to melt the material, or adhesives or other means can be used to join the strands together. It is preferred that the strands are joined together in a location of from about ½ inch to about 2 inches from the gathered end of the bundle to assure that all strands are captured.

To form a top dressing for covering a surface such as the top of a plant, the synthetic decorative moss is draped in a mat, with one end hidden beneath the mat. A plurality of the synthetic decorative mosses can be used to form a mat, with the gathered ends of each of the synthetic decorative mosses being hidden beneath the mat.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
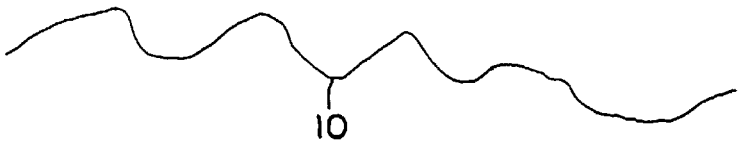
FIG. 1 is a schematic illustration of a single elongated strand of kinked synthetic material according to the invention.
Figure 2:
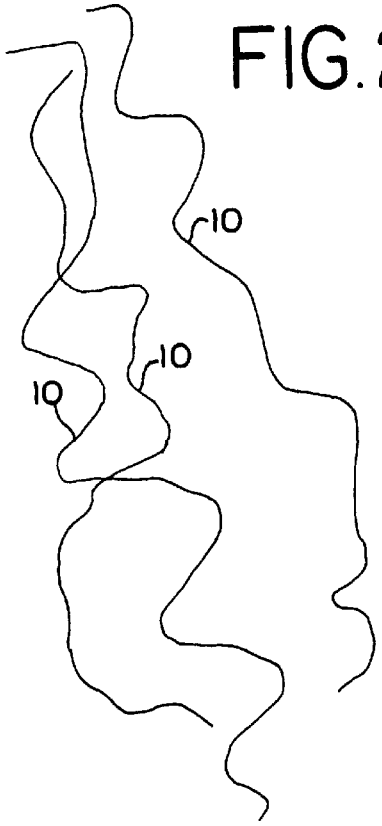
FIG. 2 is a schematic view of three of the elongated strands gathered together.

FIG. 1 illustrates a single elongated strand of kinked synthetic material, generally designated at 10, while FIG. 2 illustrates three of the strands 10 as they are being gathered together. The strands 10 are synthetic, and are preferably made of plastic, such as polypropylene, polyester or polyethylene. Other plastics could also be used, as well as other materials so long as the materials are generally resistant to deterioration and can be kinked and colored to replicate natural moss used for plant dressing.

The strands 10 are generally round in cross section, and each strand preferably has a diameter of from about 1/64 inches to about 1/16 inches, although the shape of the strands and the thicknesses may vary depending on the use envisioned for the strands.

The strands 10 may vary in length, from as little as 4 inches, or even less, to as much as 40 feet, or even more, depending on the ultimate use envisioned. Preferably, when the strands are gathered in a bundle, as described below, the strands of each bundle are of approximately the same length, although lengths can also vary in the bundles, as well.

Each of the strands 10 is colored to replicate natural moss. Preferably, the coloring comprises a combination of brown, gray, blue and green. Obviously, other colors can be used, as well, depending on the ultimate desired color for the strands.

Figure 3:
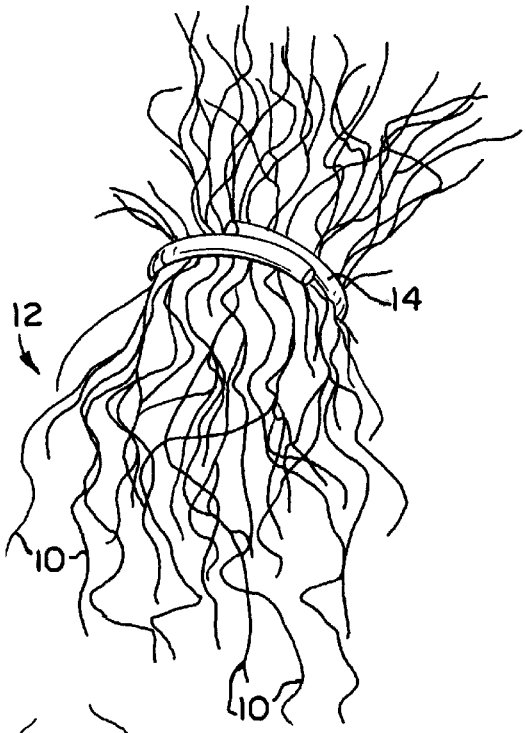
FIG. 3 is a schematic view of one end a bundle of strands which have been gathered together in a rope-like fashion and affixed together with a hog ring.
Figure 4:
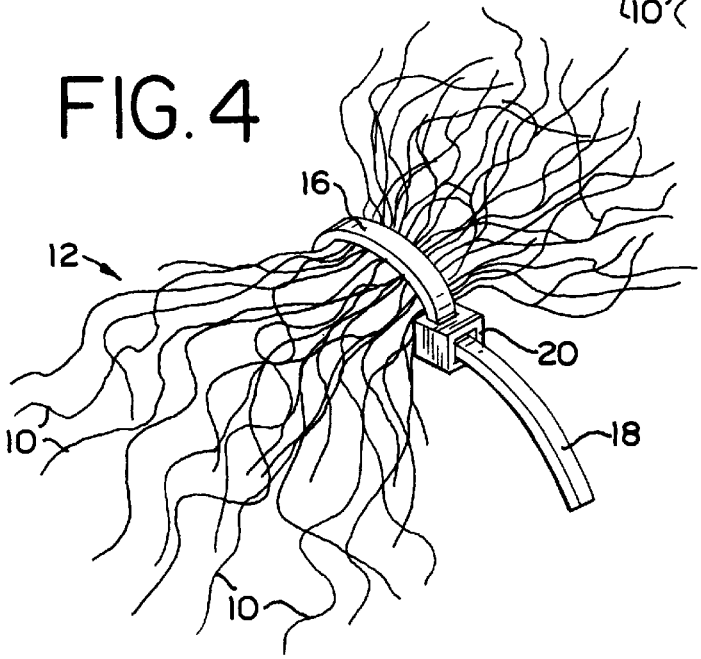
FIG. 4 is a view similar to FIG. 3, but having the strands of the bundle gathered together by a plastic tie.

The strands 10 are gathered together in non-woven bundles, and portions of two such bundles are shown in FIGS. 3 and 4, and are designated generally at 12. Turning first to FIG. 3, the bundle 12, which may comprise of from about 80 to 950 or more of the strands 10, is gathered together at one end with a hog ring 14. The hog ring 14 is preferably made of metal, but can be made of any other material so long as it, when wrapped about the bundled strands 10, tightly retains the strands 10 in the bundle 12. Preferably, the hog ring 14, and any other means of securing the strands of the bundle 12 together, is located proximate one end of the gathered strands, on the order of about ½ to 2 inches from the end of the gathered strands.

FIG. 4 is similar to FIG. 3, except that securing of the bundle is by means of a plastic tie 16. The tie may be a conventional tie in which one end 18 of the tie 16 is inserted through a clasp 20 and pulled tight, securely retaining the strands 10 in the bundle 12.

While a hog ring 14 and a tie 16 are illustrated in the drawing figures, other means of gathering the strands 10 into a bundle 12 can be employed, as well. For example, a string or the like can be used for bundling. Also, an adhesive can be used to secure all of the strands 10 together, or heat may be used to fuse one end of the strands 10 together. Whatever the means of forming the bundle according to the invention, that means is, as explained above, proximate one end of the bundle, on the order of from about ½ inch to about 2 inches from that end, although fusing or adhesive could extend from that end.

Figure 5:
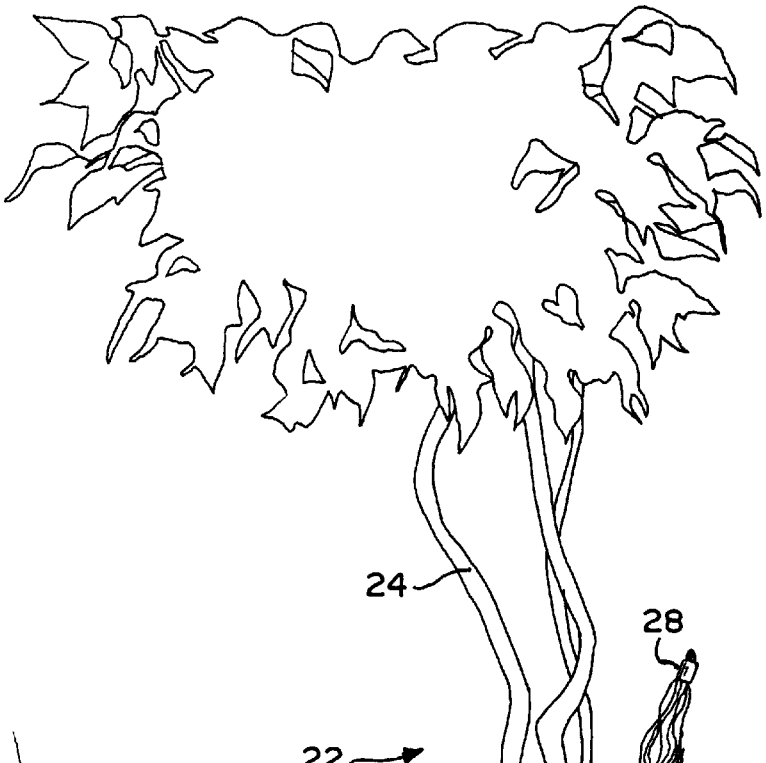
FIG. 5 is a perspective view of a plant showing the deployment of a bundle of the synthetic decorative moss according to the invention as it is wrapped around the plant to form a moss-like mat.

FIG. 5 illustrates deployment of a bundle 12 about a potted plant 22 which is composed of a plant 24 in a decorative pot 26. As illustrated, the bundle 12, which is of any desired length, is wrapped around the plant 24 in a mat-like fashion. The gathered end 28 of the bundle 12 is then tucked beneath the remaining portion of the bundle 12 to hide the end 28 beneath the mat to finish dressing of the potted plant 22.

It will be evident that, depending on the length of the bundle 12 and the size of the decorative pot 26, more than one of the bundles 12 might be utilized in dressing the top of the pot 26. In that instance, each gathered end of each bundle 12 is tucked beneath the remaining material of the bundles 12 so that the gathered ends are hidden from view. The resulting material faithfully replicates natural moss.

Figure 6:
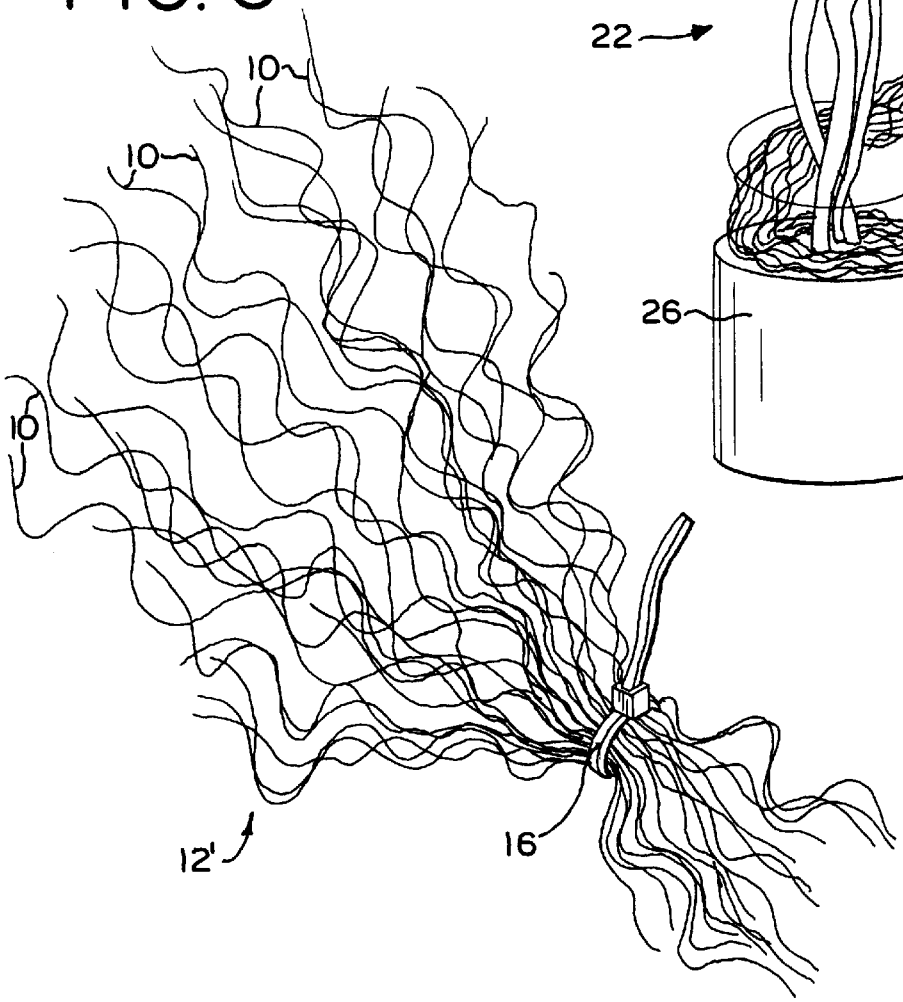
FIG. 6 is a schematic illustration of a second form or the invention, where the individual strands are relatively short so that each bundle is relatively short and a series of bundles are used for top decoration.

A second form of the invention is shown in FIG. 6. In this form of the invention, a bundle 12' is relatively short in length, about 6 inches or perhaps even less, and is gathered by a tie 16 in precisely the same manner described in the first form of the invention.

Figure 7:
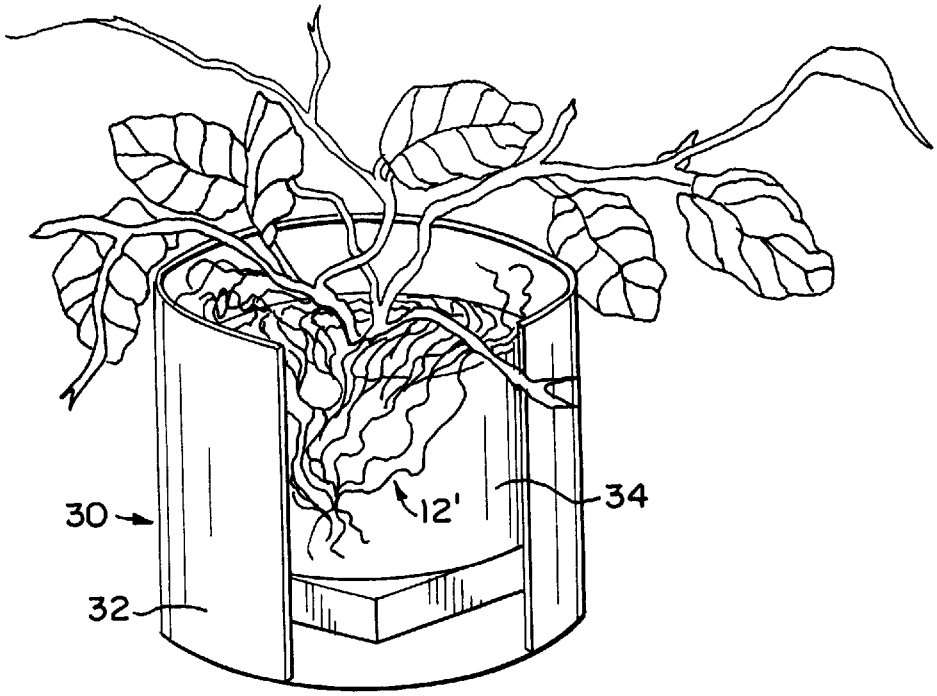
FIG. 7 is a schematic illustration of a potted plant, with a portion of the pot cut away, showing one of the bundles of FIG. 6 as it is deployed in the potted plant.
Figure 8:
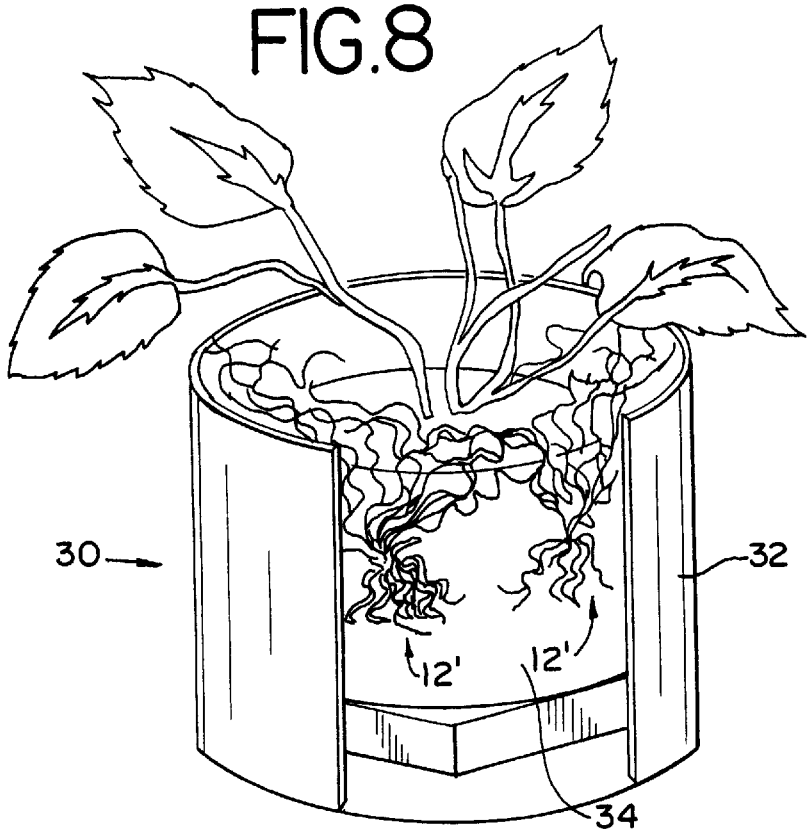
FIG. 8 is a view similar to FIG. 7, but showing two of the bundles of FIG. 6 being deployed for surface dressing of the potted plant.

However, a series of the bundles 12' are utilized, as depicted in FIGS. 7 and 8. In the pot illustrated in FIG. 7, a portion of which has been cut away to illustrate detail, the pot 30 includes an outer decorative wall 32 and an inner plant container 34, which is spaced inwardly circumferentially from the decorative wall 32, forming a gap between the wall 32 and the container 34. A series of the bundles 12' are then inserted in the gap between the decorative wall 32 and the container 34, with the gathered end downwardly and the strands extending above and over the surface of the potted plant, thus replicating moss. Alternatively, the bundles 12' can be laid atop the dirt or the gathered ends can be pushed into the dirt. In FIG. 8, two such bundles 12' are illustrated, and obviously the number of bundles 12' utilized will depend on the size of the potted plant and the density of the strands 10 of the bundles 12' that is ultimately desired.

The strands can be made in their kinked form in any one of a number of possible processes. One such process is to extrude the individual strands 10, and then kink them while still warm between plates that have peaks and valleys machined into the plates. When the still-warm strands are crushed between the plates, the plastic material cools and sets with the kinks defined by the surface structures of the main plates. The kinking preferably gives a random appearance to replicate natural moss. Whether elongated, rope-like bundles are utilized, or whether short bundles are used, the natural, kinked nature of moss is replicated by the invention, without all of the problems associated with natural moss.

Various changes can be made to the invention without departing from the spirit thereof or scope of the following claims.

What is claimed is:

1. A synthetic decorative moss, comprising a) a plurality of individual elongated strands of kinked synthetic material, said strands being gathered in a non-woven bundle in a rope-like fashion, and b) means proximate one end of said bundle for securing the strands of said bundle together.

2. A synthetic decorative moss according to claim 1 in which said synthetic material is selected from the group consisting of polypropylene, polyester and polyethylene.

3. A synthetic decorative moss according to claim 1 in which each of said strands is generally round in cross section and has a diameter of from about 1/64 inches to about 1/16 inches.

4. A synthetic decorative moss according to claim 1 in which each of said strands has a length of from about 4 inches to about 40 feet.

5. A synthetic decorative moss according to claim 1 in which said bundle comprises of from about 80 to about 950 of said strands.

6. A synthetic decorative moss according to claim 1 in which each of said strands is colored.

7. A synthetic decorative moss according to claim 6 in which the color of said strands comprises a combination of brown, gray, blue and green.

8. A synthetic decorative moss according to claim 1 in which said means for securing comprises a mechanical fastener.

9. A synthetic decorative moss according to claim 8 in which said fastener comprises hog ring.

10. A synthetic decorative moss according to claim 8 in which said fastener comprises a tie.

11. A synthetic decorative moss according to claim 8 in which said fastener comprises a string.

12. A synthetic decorative moss according to claim 1 in which said means for securing comprises fusing of said strands together.

13. A synthetic decorative moss according to claim 1 in which said means for securing is located from about ½ inch to about 2 inches from said one end.

14. A top dressing for covering a surface comprising the synthetic decorative moss according to claim 1 draped in a mat with said one end hidden beneath said mat.

15. A top dressing covering a surface comprising a plurality of the synthetic decorative moss according to claim 1 formed in a mat with said one end of each said synthetic decorative moss being hidden beneath said mat.

16. A top dressing for covering a surface, comprising a. a synthetic decorative moss having i. a plurality of individual elongated strands of kinked synthetic material, said strands being gathered in a non-woven bundle in a rope-like fashion, and ii. means proximate one end of said bundle for securing the strands of said bundle together, and b. means forming said synthetic decorative moss into a mat.

17. A top dressing according to claim 16 in which said one end is hidden beneath said mat.

18. A top dressing for covering a surface, comprising a. a plurality of synthetic decorative mosses each having i. a plurality of individual elongated strands of kinked synthetic material, said strands being gathered in a non-woven bundle in a rope-like fashion, and ii. means proximate one end of said bundle for securing the strands of said bundle together, b. means forming said plurality of synthetic decorative moss into a mat.

19. A synthetic decorative moss according to claim 18 in which said one end of each bundle is hidden beneath said mat.

* * * * *